United States Patent [19]

Noon

[11] Patent Number: 4,685,583

[45] Date of Patent: Aug. 11, 1987

[54] DISPOSABLE BEVERAGE CUP HANDLE

[76] Inventor: Kelly D. Noon, 1640 Kiowa Crest Dr., Diamond Bar, Calif. 91765

[21] Appl. No.: 864,437

[22] Filed: May 16, 1986

Related U.S. Application Data

[63] Continuation-in-part of Ser. No. 657,942, Oct. 4, 1984, abandoned.

[51] Int. Cl.[4] ..... B65D 25/28

[52] U.S. Cl. ..... 220/94 R; 229/1.5 H; 229/52 A

[58] Field of Search ..... 220/94 A, 94 R; 229/1.5 H, 1.5 B, DIG. 6, 52 A; 294/31.2

[56] References Cited

U.S. PATENT DOCUMENTS

| | | | |
|---|---|---|---|
| 1,866,805 | 7/1932 | Haywood | 229/52 A X |
| 1,910,168 | 5/1933 | Jacobs | 229/1.5 H X |
| 1,950,505 | 3/1934 | Matters | 229/1.5 H |
| 1,999,878 | 4/1935 | La Bombard | 294/31.2 X |
| 2,060,781 | 11/1936 | Annen | 229/1.5 B |
| 2,194,898 | 3/1940 | Hanford | 229/1.5 H X |
| 2,558,287 | 6/1951 | Amberg | 229/1.5 B |
| 2,560,927 | 7/1951 | Buttery et al. | 229/1.5 B |
| 2,979,226 | 4/1961 | Vesak | 229/52 A X |
| 3,104,788 | 9/1963 | Wood | 294/31.2 X |
| 3,750,933 | 8/1973 | Nicolay | 229/155 X |

*Primary Examiner*—Steven M. Pollard
*Attorney, Agent, or Firm*—William L. Chapin

[57] ABSTRACT

A handle accessory for beverage cups is fabricated from a thin, elongated strip of plastic, heavy paper, or similar flexible material. An oval-shaped enlargement of at least one end of the strip provides a hand grip. The opposite end of the strip is wrapped around a cup and joined to the handle end having the hand grip. In the preferred embodiment, an oval-shaped tab cut through one end of the strip is folded through an oval-shaped hole in the opposite end of the strip, and then inserted upward into a horizontally disposed slit in the opposite end to lock the two ends together.

5 Claims, 18 Drawing Figures

DISPOSABLE BEVERAGE CUP HANDLE

This application is a continuation-in-part of Ser. No. 06/657,942 filed Oct. 4, 1984, now abandoned.

BACKGROUND OF THE INVENTION

1. Field of the Invention

This invention relates to means for facilitating the carrying of cups containing beverages or other liquids. More particularly, the invention relates to disposable handles for use with paper, styrofoam or other plastic disposable cups of the type commonly dispensed at fast-food establishments and convenience stores.

2. Description of Background Art

Disposable cups of the type commonly dispensed at fast-food establishments, convenience stores, picnics and the like, are often fabricated from paper, styrofoam or other plastic materials. Many such cups have smooth sides and are not equipped with handles.

While styrofoam cups are inherently good insulators, cups made of paper or non-cellular plastic materials are poor insulators. Therefore, when such cups are filled with hot chocolate, tea, coffee, soup, or the like, handling the cups can be uncomfortable, sometimes to the extent that a person is caused to drop the cup.

In addition to the problem of heat, penetration through the walls of certain types of disposable cups, all cups without handles present some handling difficulties that is because the entire palm of the hand is generally required to manipulate a cup without a handle. More desirably, a cup provided with a handle may be grasped and manipulated with one or more fingers, leaving other fingers and palm to carry other articles such as rolls, doughnuts, hamburgers and hot dogs.

Recognition of the desirability of providing disposable cups with handles has stimulated various inventions related to such cups. Examples of United States patents granted on such inventions include those issued to Fick U.S. Pat. No. Des. 034,063, Feb. 12, 1901; Krueger, U.S. Pat. No. 1,985,375, Dec. 25, 1934; La Bombard, U.S. Pat. No. 1,999,378, Apr. 30, 1935; Annen, U.S. Pat. No. 2,060,781, Nov. 17, 1936; Schact, U.S. Pat. No. 2,287,644, June 23, 1944; Liebenow, U.S. Pat. No. 2,659,527, Nov. 17, 1953 and La Tourette, U.S. Pat. No. 2,867,365, Jan. 6, 1959.

The present invention provides a disposable handle which may be readily attached to disposable beverage cups not provided with adequate handles, or not provided with any handles at all.

OBJECTS OF THE INVENTION

An object of the present invention is to provide a handle which may be quickly and easily attached to beverage cups, thereby facilitating handling the cups.

Another object of the invention is to provide a handle which may be attached to disposable beverage cups, without the requirement for tools or auxiliary fastening means.

Another object of the invention is to provide a low-cost handle for attaching to beverage cups which may be imprinted with an advertising message.

Various other objects and advantages of the present invention, and its most novel features, will become apparent to those skilled in the art by reading the accompanying specification and claims.

It is to be understood that although the invention disclosed herein is fully capable of achieving the objects and providing the advantages mentioned, the structural and operational characteristics of the invention described herein are merely illustrative of the preferred embodiments. Accordingly, I do not intend the scope of my exclusive rights and privileges in the invention to be limited to the details of construction described. I do intend that reasonable equivalents, adaptations and modifications of the various embodiments and alternate forms of the present invention which are described herein be included within the scope of this invention as defined by the appended claims.

SUMMARY OF THE INVENTION

Briefly stated, the present invention comprehends a handle for beverage cups comprising an elongated flat strip of flexible material such as paper or plastic which may be conformed to the outer circumferential surface of the cup. The length of the strip is greater than the circumference of the cups which the handle is intended to be used with. Enlarged ends of the strip overly each other to form a double thickness, generally oval-shaped hand grip. Means are provided to fasten the free ends of the strip together in a clamping configuration around the cup.

DESCRIPTION OF THE PREFERRED EMBODIMENT

Figure 1:
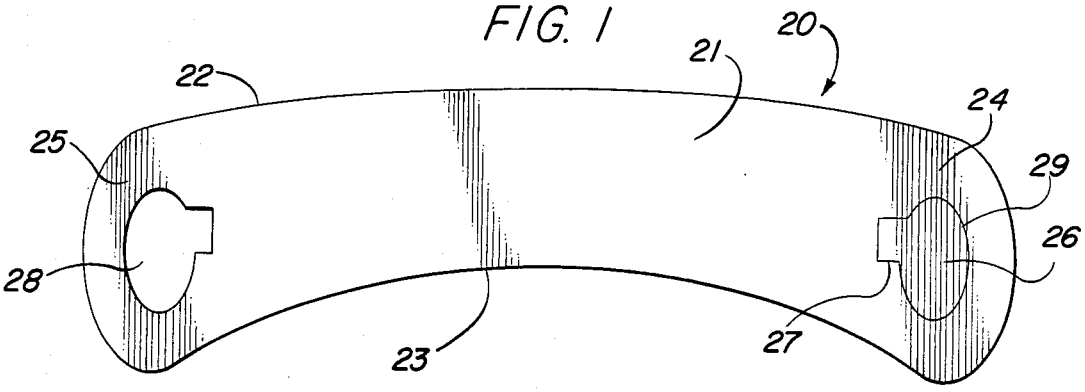
FIG. 1 is a top plan view of the basic embodiment of the beverage cup handle according to the present invention.

Referring now to FIG. 1, the basic embodiment 20 of the beverage cup handle according to the present invention is fabricated from an elongated strip 21 of thin sheet stock, typically heavy paper or plastic.

As shown in FIG. 1, the upper edge 22 of strip 21 describes a smooth convex curve and the lower edge 23 describes a smooth concave curve concentric with the curve of upper edge 22. Edges 22 and 23 are curved so that they will conform to the outer circumferential surface of a cup which has a larger diameter top opening than base. For use with cups having straight sides, strip 21 could of course be fabricated with straight, parallel upper edges 22 and lower edges 23.

Strip 21 is preferably fabricated by die cutting from paper or plastic sheet stock having a uniform thickness. The cross-sectional shape of the right end 24 of strip 21 is that of an oval with its long axis vertically disposed at right angles to the long axis of the strip. The left end 25 of strip 21 is the mirror image of right end 24, and congruent with it when the ends are folded together to overly one another.

Right end 24 of strip 21 has a generally oval-shaped tab 26 cut partially through the strip. Tab 26 is roughly symmetrical with the outer shape of end 24, but smaller. The inner portion of tab 26 has a rectangular-shaped projection. An inner edge 27 of the inwardly disposed projection of tab 26 disposed transversely to the long axis of strip 21 is left uncut, permitting tab 26 to be pivoted outward from the plane of the strip. Inner edge 27 thus functions as an integral, or live hinge for tab 26.

In the left end 25 of strip 21, a hole 28 is cut completely through the strip. Hole 28 is substantially identical in size and shape to the hole 29 left in right end 24 by pivoting tab 26 outward from the plane of strip 21.

Figure 2:
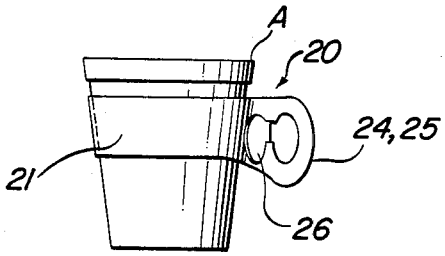
FIG. 2 is a side perspective new showing how the article of FIG. 1 is attached to a beverage cup.
Figure 3:
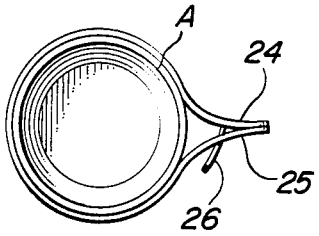
FIG. 3 is a top plan view showing the article of FIG. 1 attached to a beverage cup.

Handle 20 is fastened to a beverage cup A as shown in FIGS. 2 and 3, as follows. As shown in FIGS. 2 and 3, handle 20 is folded conformably around the outer circumferential surface of a cup A. Tab 26 is then folded outward from the plane of right end 24, through hole 29 formed by the cut around the periphery of tab 26, through hole 28 in left end 25 of strip 21, and inward towards the parallel surfaces of ends 24 and 25 of the strip, fastening the ends together. The rectangular inner portion of tab 26 fits tightly into the rectangular inner portion of hole 28, locking ends 24 and 25 securely together. The length of strip 21 is chosen so that ring-shaped band formed by locking the ends of strip 21 together exerts a negative hoop stress upon the outer circumferential surface of cup A, securing handle 20 to the cup.

An adhesive coating may be applied to the inner facing surfaces of ends 24 and/or 25 to help secure the ends together. Also, the inner surface of strip 21 may be coated with an adhesive, to help secure band 21 to the outer surface of cup A.

With handle 20 secured to cup A as described above, the cup may be picked up, transported and manipulated by grasping handle ends 24 and 25. This facilitates handling the cup and avoids the possible problem of an uncomfortable encounter between the fingers and a hot cup surface. Fingers may be inserted through holes 28 and 29 to effect a more secure grasp of the cup, if so desired.

Figure 4:
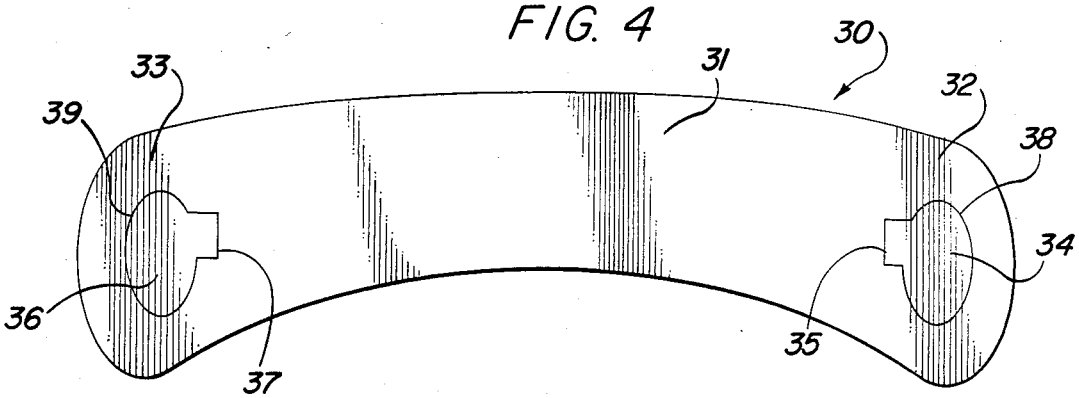
FIG. 4 is a top plan view of a second embodiment of the beverage cup handle according to the present invention.
Figure 5:
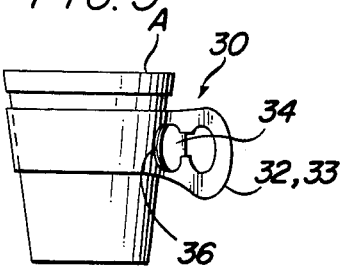
FIG. 5 is a side perspective view showing how the article of FIG. 4 is attached to a beverage cup.
Figure 6:
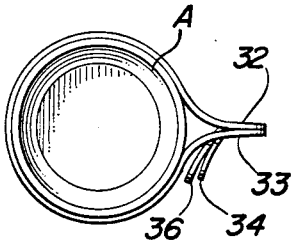
FIG. 6 is a top plan view showing the article of FIG. 4 attached to a beverage cup.

A second embodiment 30 of the invention is shown in FIGS. 4 through 6. In the second embodiment, both ends 32 and 33 of strip 31 are identical. Right end 32 has an oval-shaped tab 34 joined to strip 31 by edge 35 functioning as a live hinge, and left end 33 has an oval-shaped tab 36 joined to the strip by edge 37 functioning as a live hinge. In this embodiment, handle 30 is secured to cup A by folding tab 34 outward from the plane of right end 32 through hole 38 formed by the cut around the periphery of tab 34, and both tabs 34 and 36 are folded outward from the planes of ends 32 and 33 through hole 39 formed by the cut around the periphery of tab 36, and thence inward towards the parallel surfaces of ends 32 and 33 of strip 31, locking the ends together.

Figure 16:
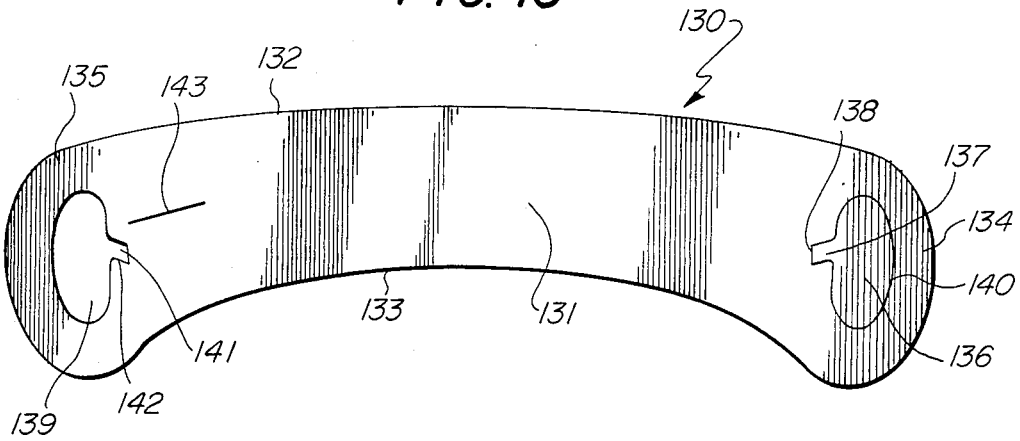
FIG. 16 is a top plan view of a sixth embodiment of the beverage cup handle according to the present invention.
Figure 17:
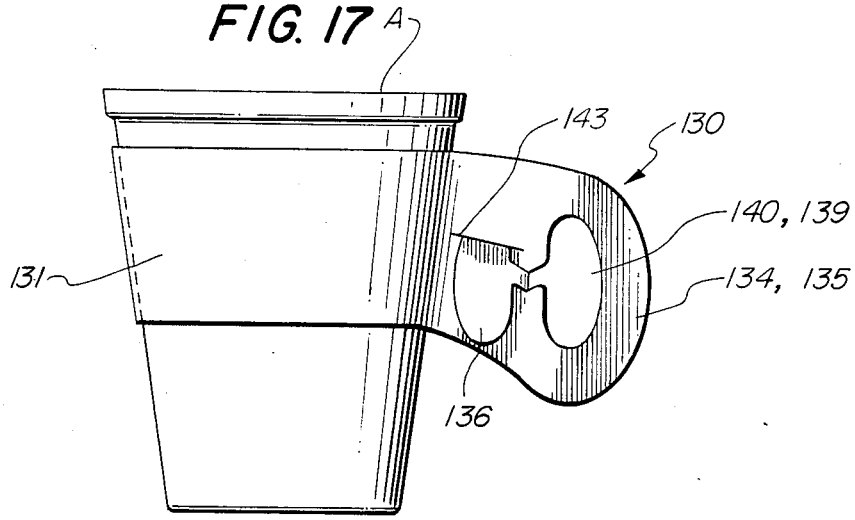
FIG. 17 is a side perspective view showing how the article of FIG. 16 is attached to a beverage cup.
Figure 18:
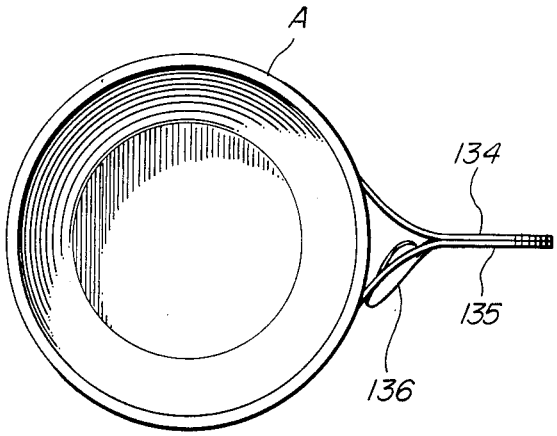
FIG. 18 is a top plan view showing the article of FIG. 16 attached to a beverage cup.

A modified form of the basic embodiments of the invention shown in FIGS. 1 through 6 is illustrated in FIGS. 16 through 18. The modified form 130 of the handle includes an elongated strip 131 of thin plastic or paper having a convex upper edge 132 and a concave lower edge 133.

Right end 134 of strip 131 is of a generally oval shape in transverse cross section. The left end 135 of strip 131 has a transverse cross-sectional shape which is the mirror image of right end 134, and therefore may be placed in congruent alignment with the right end when the two ends are folded towards one another.

Right end 134 of strip 131 has a generally oval-shaped tab 136 cut partially through the strip. Tab 136 is similar in shape to the outer arcuate edge of right end 134, but of smaller size. Continuous with the inner transverse edge of tab 136 is a generally rectangular-shaped projection 137 disposed inwardly at a slight downward angle from the longitudinal axis of the strip. The inner edge 138 of projection 137 is left uncut, permitting tab 136 to be pivoted outward from the plane of the strip. Inner edge 138 thus functions as an integral, or live hinge for tab 136.

In the left end 135 of strip 131, a hole 139 is cut completely through the strip. Hole 139 is substantially identical to the hole 140 left in right end 134 of the strip 131 by pivoting tab 136 outward from the plane of the strip. Thus, hole 139 includes a generally rectangular-shaped, inwardly disposed portion 141 forming at its bottom edge a ridge 142 disposed inwardly at a slight downward angle from the longitudinal axis of strip 131.

Left end 135 of strip 131 includes a linear slit 143 cut through the strip. Slit 143 is positioned above rectangular-shaped portion 141 of hole 139, and is disposed inwardly at a slight upward angle from the longitudinal axis of the strip.

Handle 130 is fastened to beverage cup A as shown in FIGS. 17 and 18 as follows. As shown in FIGS. 17 and 18, handle 130 is folded conformally around the outer circumferential surface of a beverage cup A. Tab 136 is then folded outwards from the plane of right end 134 of strip 131, through hole 140 formed by the cut around the periphery of tab 136, through hole 139 in left end 135 of the strip, and back inwards towards the plane of the left end of the strip. In folding tab 136 through hole 139 in the left end of the strip, rectangular-shaped inner portion 137 of tab 136 lockingly engages rectangular portion 141 of the hole, the lower edge of the rectangular portion of the tab being supported by ridge 142 at the bottom edge of hole 139. Thus, lockingly engaged, right end 134 and left end 135 of strip 131 are secured incongruent alignment against a possible vertical displacement relative to each other.

The final step in fastening handle 130 to a cup A entails securing right end 134 and left end 135 of strip 131 of the handle against displacement relative to one another in a direction perpendicular to their planes. This is accomplished in two steps. First, oval-shaped tab 136 of right end 134 of strip 131 is folded downwards into parallel alignment with left end 135 of the strip. Finally, the upper end of oval tab 136 of right end 134 of strip 131 is inserted upwards into slit 143 in left end 135 of the strip, securely locking left and right ends together and thereby securing handle 130 to cup A.

Figure 7:
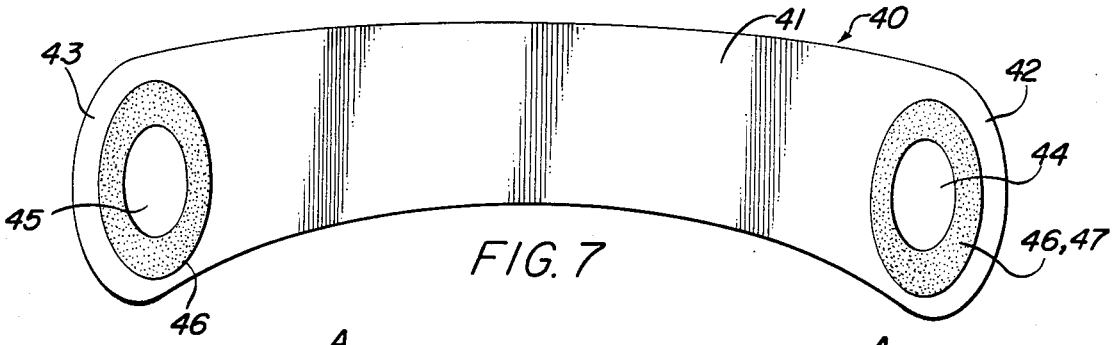
FIG. 7 is a top plan view of a third embodiment of the beverage cup handle according to the present invention.
Figure 8:
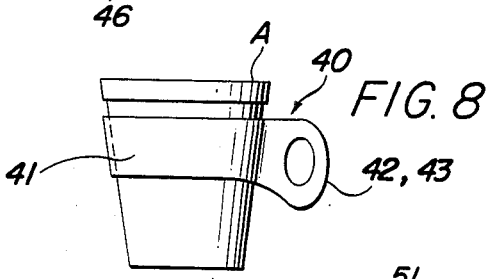
FIG. 8 is a side perspective view showing how the article of FIG. 7 is attached to a beverage cup.
Figure 9:
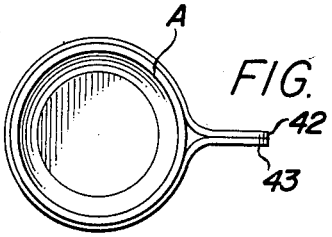
FIG. 9 is a top plan view showing the article of FIG. 7 attached to a beverage cup.

A third embodiment 40 of the invention is shown in FIGS. 7 through 9. In the third embodiment, elongated handle strip 41 has an oval-shaped right end 42 identical in shape to left end 43. In this third embodiment, however, identical oval-shaped finger holes 44 and 45 are cut completely through ends 42 and 43, respectively. On at least one end of strip 41, an annular-shaped region 46 on the upper surface of the strip, concentric with a finger hole, is coated with a contact adhesive. Adhesive region 46 is protected by a paper ring 47 having a lower surface treated to provide poor adhesion with the contact adhesive. To use handle 40, protective ring 47 is peeled off of adhesive-coated annular region 46. Handle 40 is then folded conformally around cup A. The inner surfaces of right end 42 and left end 43 are then pressed together. Adhesive bonding between the adhesive on annular-shaped region 46, and the inner, facing surface of the opposite handle end secures the handle ends together.

Figure 10:
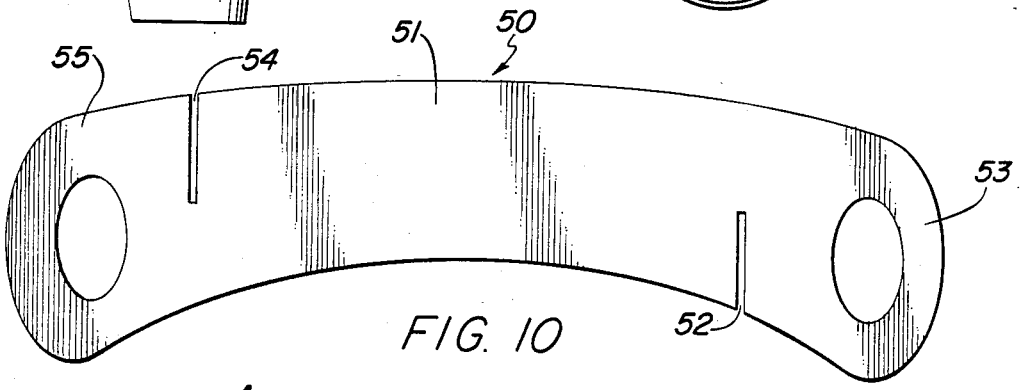
FIG. 10 is a top plan view of a fourth embodiment of the beverage cup handle according to the present invention.
Figure 11:
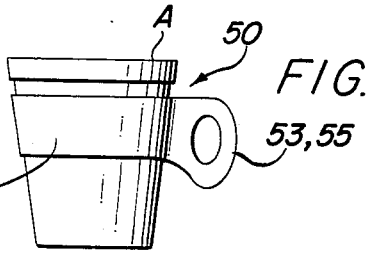
FIG. 11 is a side perspective view showing how the article of FIG. 10 is attached to a beverage cup.
Figure 12:
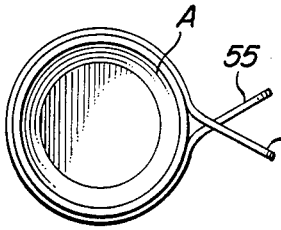
FIG. 12 is a top plan view showing the article of FIG. 10 attached to a beverage cup.

A fourth embodiment 50 of the invention is shown in FIGS. 10 through 12. In that embodiment, a first vertically disposed slit 52 is cut upward from the bottom edge of elongated handle strip 51 at the junction of the oval-shaped right end 53 of the handle strip with its elongated central section. A second vertically disposed slit 54 is cut downward from the top edge of elongated handle strip 51 at the junction of the oval-shaped left end 55 of the handle strip with its elongated central section.

To use handle 50, handle strip 51 is folded conformally around cup A with right end 53 skewed upward and left end 55 skewed downward from the normal parallel positions of the ends. Slits 52 and 54 are then with each other, and ends 53 and 55 moved into congruence, locking ends 53 and 55 together.

Figure 13:
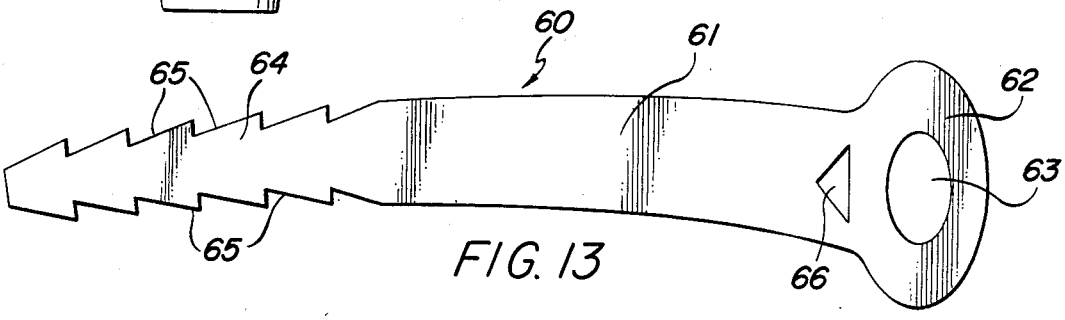
FIG. 13 is a top plan view of a fifth embodiment of the beverage cup handle according to the present invention.
Figure 14:
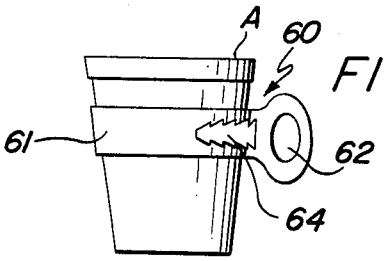
FIG. 14 is a side perspective view showing how the article of FIG. 13 is attached to a beverage cup.
Figure 15:
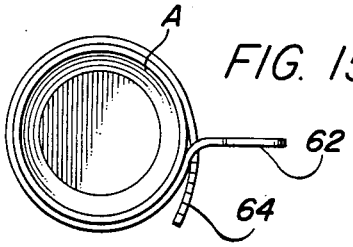
FIG. 15 is a top plan view showing the article of FIG. 13 attached to a beverage cup.

A fifth embodiment 60 of the invention is shown in FIGS. 13 through 15. That embodiment of the invention has an elongated handle strip 61 with concentric curved sides. One end 62 of the strip has an enlarged oval-shape, and a smaller perimeter oval finger hole 63 cut through the strip in center of end 62.

The opposite end 64 of strip 61 contains a plurality of saw-tooth shaped serrations 65 on the upper and lower edges of strip, symmetrically disposed about the long axis of the strip.

To use handle 60, handle strip 61 is folded conformally around cup A. The upper and lower edges of serrated end 64 of handle strip 61 are folded slightly toward one another, and end 64 is then inserted through triangular cross-section hole 66 cut through the handle strip near the junction of right end 62 with the long center portion of the handle strip. Serrated end 64 is then pulled through hole 66 sufficiently far to cinch the long center portion of handle strip 61 firmly around the outer circumferential surface of cup A. The upper and lower serrated edges of end 64 are then restored to their unfolded positions because of the natural elasticity of the strip material. Alternatively, the user can manually assist restoring the upper and lower serrated edges to their original position in the plane of strip 61. In this unfolded position, the sloping sides of the serrations abut against the peripheral material around hole 66, firmly locking handle 60 around cup A.

What I claim is:

1. A handle accessory for use with beverage cups comprising an elongated strip of thin, substantially uniform thickness flexible material, said strip having:

(a) arcuate, greatly concentric upper and lower longitudinal edges, (b) oval enlargements at both longitudinal ends of said strip, said oval-shaped enlargements being congruent and providing hand grip means when said ends of said strip are folded conformally around the outer circumferential wall of a cup, (c) an oval-shaped tab cut through at least a first one of said oval-shaped enlargements, said tab having a generally rectangular hinge member extending longitudinally inward from the inner transverse edge of said tab, (d) a generally oval-shaped perforation cut through said oval-shaped enlargement of said second end of said strip, said perforation being congruent with said tab and said hinge member, whereby said tab and said hinge member may be folded in a continuous rotational motion outwards from the plane of said strip through said perforation and backwards towards the plane of said strip, the lower edge of said rectangular hinge member being supported by the upper edge of the rectangular portion of said perforation, thereby securing together said first and second enlargements of the longitudinal ends of said strip, and (e) a generally longitudinally disposed, linear slit cut through said strip, said slit being positioned inwards of the inner lateral edge of said perforation and above the rectangular portion of said perforation, whereby the upper longitudinal edge of said tab may be inserted lockingly upwards into said slit.

2. A handle accessory for use with beverage cups comprising an elongated strip of thin, substantially uniform thickness flexible material, said strip having:

(a) arcuate, greatly concentric upper and lower longitudinal edges, (b) oval enlargements at both longitudinal ends of said strip, said oval-shaped enlargements being congruent and providing hand grip means when said ends of said strip are folded conformally around the outer circumferential wall of a cup, (c) a first vertically disposed slit cut upwards from the lower edge of said elongated handle strip near the inner transverse junction of a first one of said oval-shaped enlargements with the elongated intermediate section of said strip, and, (d) a second vertically disposed slit cut downwards from the upper edge of said elongated handle strip near the inner transverse junction of the second one of said oval-shaped enlargements with the intermediate section of said strip, whereby said first and second slits may be engaged with one another to lock said first and second ends of said strip together.

3. The article of claim 2 further comprising finger holes cut through both of said oval-shaped enlargements of said strip.

4. A handle accessory for use with beverage cups comprising an elongated strip of thin, substantially uniform thickness flexible material, said strip having:

(a) arcuate, greatly concentric upper and lower longitudinal edges, (b) an oval enlargement of a first longitudinal end of said strip, said oval enlargement forming a hand grip, (c) a plurality of saw-tooth shaped serrations in the upper and lower edges of the second longitudinal end portion of said strip, said serrations being symmetrically disposed about the longitudinal axis of said strip, and, (d) a perforation cut through said strip near the inner transverse junction of said oval-shaped enlargement of said first end of said strip with the intermediate section of said strip, said perforation being adapted to lockingly receive said serrated end of said strip when said end is inserted through said perforation.

5. The article of claim 4 further comprising a finger hole cut through said oval enlargement of said first longitudinal end of said strip.

* * * * *